United States Patent [19]

Rohrer

[11] Patent Number: 4,600,128

[45] Date of Patent: Jul. 15, 1986

[54] CLEANSER CONTAINER

[75] Inventor: Hermann Rohrer, Münsingen, Switzerland

[73] Assignee: Sipuro A.G., Münsingen, Switzerland

[21] Appl. No.: 672,293

[22] Filed: Nov. 15, 1984

[30] Foreign Application Priority Data

Nov. 25, 1983 [CH] Switzerland ..... 6325/83

[51] Int. Cl.[4] ..... B67D 1/16

[52] U.S. Cl. ..... 222/108; 222/571; 222/206

[58] Field of Search ..... 222/108, 571, 572, 566; D9/373, 374, 404, 410

[56] References Cited

U.S. PATENT DOCUMENTS

| | | | |
|---|---|---|---|
| D. 200,263 | 2/1965 | Woodard | D9/374 |
| 280,048 | 6/1883 | Laumaster | 222/108 |
| 866,807 | 4/1907 | Pitts | 222/108 |
| 1,165,787 | 12/1915 | Lance | 222/109 |
| 2,722,346 | 4/1953 | Yokota | 222/108 X |
| 2,750,063 | 7/1955 | Opsitnik | 222/571 |
| 4,437,587 | 3/1984 | Duering | 222/207 |

*Primary Examiner*—Joseph J. Rolla
*Assistant Examiner*—Jay I. Alexander
*Attorney, Agent, or Firm*—Philip M. Shaw, Jr.

[57] ABSTRACT

The top wall of the container opposite the bottom slopes upward slightly at one side where a curved neck adjoins it. At the far end of the neck, there is a threaded cylindrical mouthpiece holding an insert, which may have a drip-disk at the outer end if the container is used for a liquid cleanser. The center line of the cylindrical mouthpiece is slightly inclined downward relative to the horizontal. A depression in the top wall catches drops of liquid falling from the drip-disk, if any. In the area of transition from the top wall to the neck, the latter is partially encircled by a groove leading into the depression. Any drops of liquid clinging to the neck are guided by this groove into the depression. Thus the part of the container intended to be grasped always remains dry.

6 Claims, 4 Drawing Figures

CLEANSER CONTAINER

DESCRIPTION

TECHNICAL FIELD

This invention relates to packaging items, and more particularly to a container for cleansers in liquid or powder form, especially for cleaning toilet bowls, of the type having a bottom, a cover wall situated opposite the bottom, from which cover wall a neck portion projects in the region of a narrow side, and a cap for closing the outlet on the neck portion.

DISCLOSURE OF INVENTION

A container for holding liquid toilet cleanser, having a neck portion bent first in one direction and then back in the opposite direction, is commercially available. This design makes it possible to measure out the amount of cleanser to be expelled. In order to arrive at the desired quantity, it is necessary to hold the container relatively far down in the toilet bowl. Furthermore, any liquid cleanser which may be dripping from the spout can run down the outside of the neck part onto the outer surface of the container.

It is an object of this invention to provide an improved cleanser container which need not be held far down in the toilet bowl.

A further object of this invention is to provide such a container on the outside of which dripping liquid cannot readily run down from the spout.

To this end, in the cleanser container according to the present invention, of the type initially mentioned, the neck portion is arcuately bent and exhibits a change of direction of 80°–110°, the radius of curvature of the center line of the neck portion being about 2–4 cm., an insert having a passage duct is inserted in the free end of the neck portion, the cover wall has a depression for catching any cleanser dropping from the insert, and the insert ends approximately over the depression.

Preferred embodiments of the invention will now be described in detail with reference to the accompanying drawings, in which:

BEST MODE FOR CARRYING OUT THE INVENTION

Figure 1:
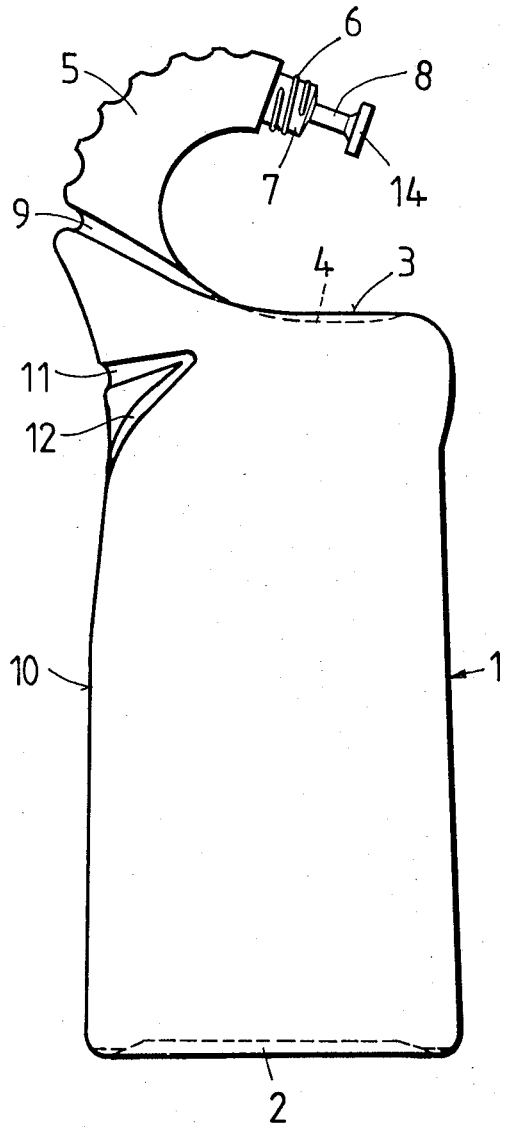
FIG. 1 is an elevation of the invented container in a first embodiment, with the cap removed.
Figure 2:
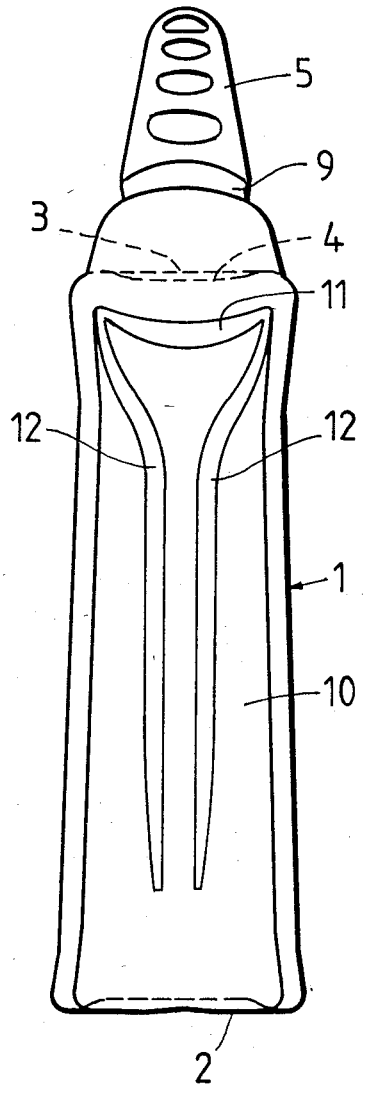
FIG. 2 is an elevation of one side of the container.

FIGS. 1 and 2 show a container 1 substantially in the shape of a rectangular parallelepiped, having a bottom 2 and a top wall 3 situated opposite thereto. Top wall 3 rises at the left-hand side, as viewed in FIG. 1, and includes a depression 4 approximately in the middle. Extending from the raised portion of top wall 3 is a curved, tapering neck portion 5. The far end of neck 5 forms a shoulder, which is followed by a hollow cylindrical mouthpiece 7 having a thread 6. Within mouthpiece 7 is an insert 8 to be described in detail below with reference to FIG. 3.

The radius of curvature of the center line of neck 5 is from 2 to 4 cm, preferably about 3 cm. The curvature of neck 5 is such that the center line of insert 8 is downwardly inclined at about 10° to the horizontal and the end of insert 8 is situated approximately above the deepest part of the above-mentioned depression 4. Thus any drops of cleanser which may be clinging to the outer end of insert 8 can drip into depression 4, where they remain and possibly evaporate and thus do not run down the rest of the outside of container 1 which must be grasped when the container is used.

At the location where neck 5 meets top wall 3, the former is partially encircled by a groove 9, the ends of which open out into depression 4. The purpose of groove 9 is to catch any drops of cleanser which may be clinging to neck 5 and guide them into depression 4.

Below the base of neck 5, a transverse groove 11 running more or less horizontally is formed in the narrow side 10 of container 1 adjacent to the neck region. Each end of transverse groove 11 opens into a respective upswept longitudinal groove 12 which otherwise runs along narrow side 10 of container 1. Transverse groove 11 and longitudinal grooves 12 are provided to carry off any cleanser which may in an extreme case run down past the base of neck 5. The parts of container 1 which are grasped when it is in use are thus prevented from becoming soiled by dripping or overflowing liquid cleanser. Any cleanser which has collected in depression 4 can drip through groove 9 into the toilet bowl the next time container 1 is used.

Figure 3:
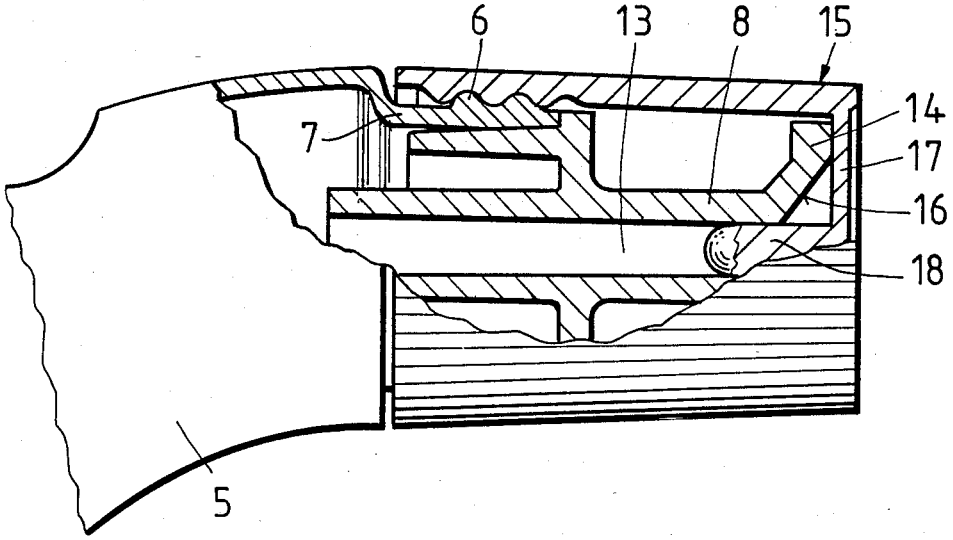
FIG. 3 is a view on a larger scale of the end of the neck portion of the container, partially in section.

The end of neck 5 of the container 1 illustrated in FIGS. 1 and 2 is shown on a larger scale, and partially in section, in FIG. 3. Insert 8 includes a duct 13 passing through it, and disposed at the outer end of insert 8 is a drip-disk 14. Engaging thread 6 of cylindrical mouthpiece 7 at the end of neck 5 is the internal thread of a cap 15 covering insert 8. In the area of drip-disk 14, duct 13 widens outwardly to form a sort of funnel 16 into which the liquid cleanser in that area is drawn by suction at the moment when pressure on the yielding container 1 is released. If a drop of cleanser should still remain at the outer end of duct 13 when container 1 is righted again, it will be guided by drip-disk 14 into depression 4.

Extending from the inside of the end wall 17 of cap 15 toward the mouth of the cap is a cylindrical stopper 18. When cap 15 is screwed on, stopper 18 projects into duct 13 and seals it. Furthermore, the inside of end wall 17 presses against the annular end face of drip-disk 14 so that container 1 is tightly closed.

Figure 4:
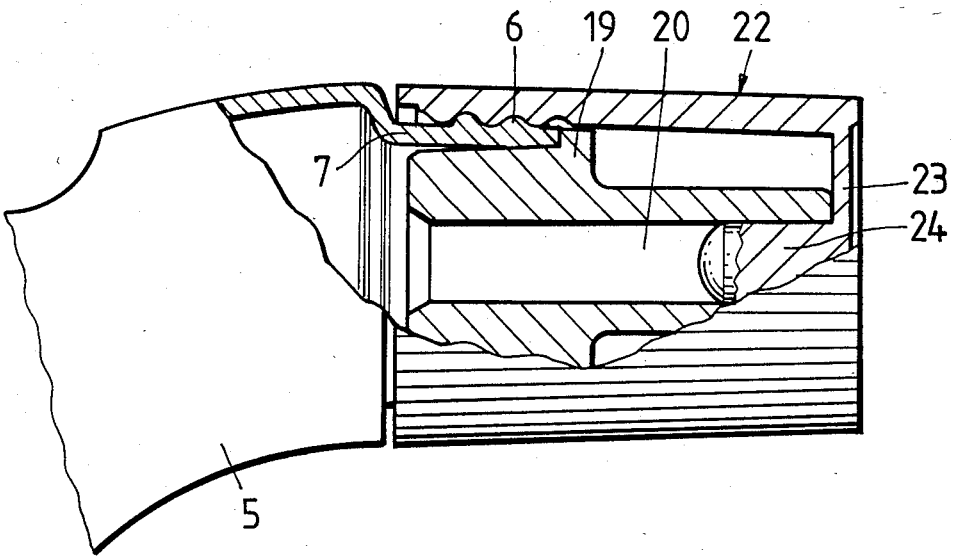
FIG. 4 is a view analogous to FIG. 3 of the end of the neck portion in another embodiment of the invention.

Instead of insert 8, an insert 19 having a duct 20 passing through it may be placed in the outer end of neck 5, as shown in FIG. 4. Duct 20 is larger in diameter than duct 13, so that the container may be used for a dry cleanser rather than a liquid one, the cleansing powder being blown out through duct 20 when container 1 is squeezed. The near end of duct 20 preferably widens inwardly so that it is easier for the cleansing powder to get out.

A cap 22 has an internal thread engaging thread 6 of cylindrical mouthpiece 7 at the free end of neck 5. A stopper 24 extends from the inside of the end wall 23 of cap 22 toward the mouth of the cap and projects into duct 20 when the cap is screwed on, thus sealing the container.

When container 1 holds a dry cleanser, the diameter of duct 20 should be in the range of 2–5 mm, preferably about 3 mm. The cleansing powder should comprise at least 40% by weight of particles from 0.25 to 0.5 mm in size, and at least the same percentage of particles from 0.5 to 1 mm in size. Moreover, it is advantageous if the container tapers from top wall 3 toward bottom 2. When the container is tipped, there is produced in this way a sufficiently large air space in the rearward end of the container; and when the latter is squeezed, air is pressed through the powder mixture so that the particles of powder are carried along in duct 20. The dry cleanser should have as small a proportion as possible of fine particles, i.e., those less than 0.25 mm in size, because otherwise the cleansing powder agglomerates and becomes impermeable to air. On the other hand, the dry cleanser must not be so coarse that it slides down the wet surface of the toilet bowl to which it is applied, instead of clinging to it. Even when container 1 holds dry cleanser, depression 4 in top wall 3 and grooves 9, 11, and 12 are not pointless because when the container is in use, neck 5 and insert 19 may be splashed with flushed water, which will then be kept away from the gripping surfaces of the container as described above in connection with the liquid cleanser.

When the container is intended for use with a dry cleanser, bottom 2 should preferably include an opening provided with a countersunk plug so that the container can easily be filled with cleansing powder.

What is claimed is:

1. A container for liquid or dry cleanser, particularly toilet-bowl cleanser, of the type having a bottom, at least one sidewall, a top wall situated opposite said bottom, a neck portion projecting from said top wall in the vicinity of said sidewall and including an outlet opening at the end of said neck portion remote from said top wall, said neck portion bent arcuately so as to exhibit a change of direction of 80°–110°, an insert piece introduced into said outlet opening of said neck portion and having a duct passing therethrough, wherein the improvement comprises a depression in said top wall, the end of said insert piece remote from said neck portion being situated approximately above the middle of said depression, and wherein said top wall slopes away from said bottom in the area of the base of said neck portion;

a groove partially encircling said neck portion at the base thereof and leading to said depression;

a transverse groove running substantially horizontally in said sidewall below the base of said neck portion and two longitudinal grooves, each extending downward in said sidewall from a respective end of said transverse groove.

2. A container as recited in claim 1 wherein the center line of said neck portion has a radius of curvature of about 2 to 4 cm.

3. The container of claim 1 for use with dry cleanser, wherein said insert includes a freely projecting cylindrical portion through which said duct extends.

4. The container of claim 1 for use with liquid cleanser, further comprising a drip-disk disposed at the end of said insert piece remote from said neck portion and above said depression.

5. The container of claim 4, wherein said drip-disk includes a mouth, said duct widening out toward said drip-disk near said mouth.

6. The container of claim 5, wherein the longitudinal axis of said duct is inclined by about 10° to the horizontal, whereby the end of said duct remote from said neck is situated nearer to said depression than the end of said duct nearest said neck.

* * * * *